United States Patent [19]

Pickrel

[11] 4,390,131

[45] Jun. 28, 1983

[54] METHOD OF AND APPARATUS FOR COMMINUTING MATERIAL

[76] Inventor: Jack D. Pickrel, 12621 W. Dakota Dr., Lakewood, Colo. 80228

[21] Appl. No.: 232,536

[22] Filed: Feb. 9, 1981

[51] Int. Cl.[3] ..... B02C 19/00

[52] U.S. Cl. ..... 241/1; 241/301

[58] Field of Search ..... 241/1, 301, 5, 39, 47, 241/15, 18

[56] References Cited

U.S. PATENT DOCUMENTS 3,255,793 6/1966 Clute ..... 241/1 X

*Primary Examiner*—Mark Rosenbaum

*Attorney, Agent, or Firm*—Horace B. Van Valkenburgh

[57] ABSTRACT

Produce air flow longitudinally through circular inlet passage toward frusto-conical chamber which expands to a cylindrical chamber. Produce air flow tangentially of cylindrical chamber, as by blower, to produce spiral flow therein and in a larger, coaxial annular chamber with a central restrictor having a projection extending into cylindrical chamber. Material fed into inlet passage, as through hopper or at open inlet end, which may be bell shaped. Comminuted material discharged from annular chamber through tangential duct, in which air flow is produced by another blower. Still another blower may discharge at acute angle longitudinally of inlet passage. Restrictor may be hemispherical or conical and also adjustable forwardly or rearwardly. Projection of restrictor may be cylindrical or cylindrical with rounded front end and also adjustable forwardly or rearwardly.

29 Claims, 7 Drawing Figures

34
A
36
32
25
23
31
24
45
45
26
R
46
C
18
35
45
35
32

METHOD OF AND APPARATUS FOR COMMINUTING MATERIAL

This invention relates to a method of and apparatus for comminuting material, which may approach disintegration.

BACKGROUND OF THE INVENTION

U.S. Pat. No. 3,255,793 discloses a Vacuum Comminutor which includes a suction device or blower having a rotor with essentially tangential vanes of special configuration and a central inlet connected to a cylindrical, tubular segment at the larger end of a cone, whose smaller end is connected to a cylindrical tube into which the material to be comminuted is fed. Each rotor vane has a trough like cross section, while a cutting device having a cutting edge facing the blower inlet extends radially into the inlet. The suction produced by the suction blower is stated to induce a flow through the cylindrical tube in the form of an elongated spiral, through the cone in an axially condensed, conical spiral corresponding to the cone and between adjacent blower vanes in a conical spiral. A region of reduced air pressure is stated to be produced within the cone and that as the material passes into the blower casing, explosions of the various particles of the materials occur which reduces or comminutes the particles to smaller size. It is also stated that the theory is that the explosions or comminution of the materials occurs because of the fact that the internal pressures of the particles of the material are greater than the external or air pressure on the particles to a degree that the internal pressures cause a rupturing and a fracturing of the particles into a number of different parts.

The comminutor thus constructed has operated successfully in comminuting material, but has not been successful commerically. It is understood that the vanes of the blower rotor, being subject to comminuted material, have worn so rapidly, particularly at the tips and leading edges, that the expense of replacement has been unduly high. Also, that the wear tends to be uneven, so that undue vibration often requires the rotor to be replaced before any vanes are worn out. It is understood that a very considerable amount of money has been spent in attempting to find a material for the blower rotor vanes which will withstand the wear, as well as redesigning the rotor vanes and/or blower to reduce the wear, but without success.

In the case of a comminutor having a fan with inclined blades rather than the trough-like section of U.S. Pat. No. 3,255,793, but otherwise corresponding thereto, and having a frusto-conical section whose inlet was 6 inches in diameter and outlet was 15 inches in diameter, with the fan driven by a 30 hp motor, the maximum feed which could be achieved was one ton of gold ore per hour. The fan required replacement at the end of 100 hours of operation. The tips of the fan blades were worn razor thin by the passage of particles, although not as small in size as the particles produced by the present invention. Also, the wear was uneven so that the fan became unbalanced, while the ore was damp and tended to build up a crust on the fan blades which was not uniform, accentuating the balance problem. Since the fan shaft was overhanging, the bearings for the shaft also became unduly worn.

Among the objects of this invention are to provide an apparatus for comminuting material in which the material does not engage any rotating or moving parts; to provide a method of comminuting material which is particularly adapted to be carried out by the apparatus of this invention; to provide such a method and apparatus in which a flow of air is produced or induced in a connected series comprising an elongated passage, an expanding frusto-conical chamber, a cylindrical chamber and a larger annular chamber containing a central restrictor, a portion of which extends into the cylindrical chamber; to provide such a method and apparatus in which such flow of air is produced by injection of air generally longitudinally of said passage and tangentially into said cylindrical or annular chamber; to provide such a method and apparatus in which a flow of air is produced in a discharge duct extending tangentially from said annular chamber, as by injecting air generally longitudinally of said duct; to provide such apparatus in which all flow of air may be produced by a source of air, such as a blower, located exteriorly of the passage or chamber; to provide such a method and apparatus which may be varied to accomodate different sizes of material and material having different characteristics; to provide such method and apparatus in which the restrictor may be provided in more than one form and also may be adjustable; to provide such apparatus which is economical to build and operate; and to provide such method and apparatus which is effective and efficient in use.

SUMMARY OF THE INVENTION

The method of this invention includes producing a flow of air generally longitudinally through an elongated passage in the direction of a connected, frusto-conical chamber which expands to a connected cylindrical chamber, producing a flow of air tangentially of the cylindrical chamber to produce a spiral flow in the cylindrical chamber as well as in a connected annular chamber having a greater diameter than the cylindrical chamber and having a central restrictor which includes a projection extending into the cylindrical chamber. The spiral flow of air in the cylindrical chamber induces a spiral flow in the frusto-conical chamber and also produces a lower pressure centrally thereof. By feeding material into the elongated passage, either at an intermediate position or at the open inlet end, such material is pulled into the frusto-conical chamber and passes into the central lower pressure area, preferably a vacuum, at an appropriate speed so that the abrupt change in pressure produces a separation of particles from each piece of material. Comminuted material is discharged from the annular chamber through a tangential duct, in which flow of air may be produced by introducing air, as from a blower, in a longitudinal direction away from the annular chamber. Flow of air in the inlet passage may be produced by a blower having a discharge duct connected at an acute angle with the passage in the direction of the next chamber. A tangential flow of air in the cylindrical chamber may be produced by a blower having a discharge duct connected tangentially with the chamber. The portion of the restrictor in the annular chamber may be hemispherical or conical and may also be adjustable forwardly or rearwardly of the annular chamber to adjust the distance between the intersection of the cylindrical and annular chambers and the surface of the hemisphere or cone. The projection of the restrictor may be cylindrical or cylindrical with a rounded front end and may also be adjustable forwardly and rearwardly to accommodate adjustments of the hemisphere or cone. Alternatively, the tangential air flow in the cylindrical chamber may be induced by air introduced tangentially into the annular chamber, as by a blower having a discharge duct which connects tangentially with the annular chamber. In such instance, the blowers connected to the cylindrical chamber and the discharge duct leading from the annular chamber may become unnecessary. Provision for supplying a suitable conditioning reagent, when appropriate, to the inlet of the passage may be provided, such as a nozzle, while the passage inlet may be bell-shaped to increase the amount of exterior air whose flow is induced into the inlet of the passage.

Additional objects and novel features will become apparent from the description which follows, taken in conjunction with the accompanying drawings.

THE DRAWINGS

DESCRIPTION OF THE PREFERRED EMBODIMENT

Figure 1:
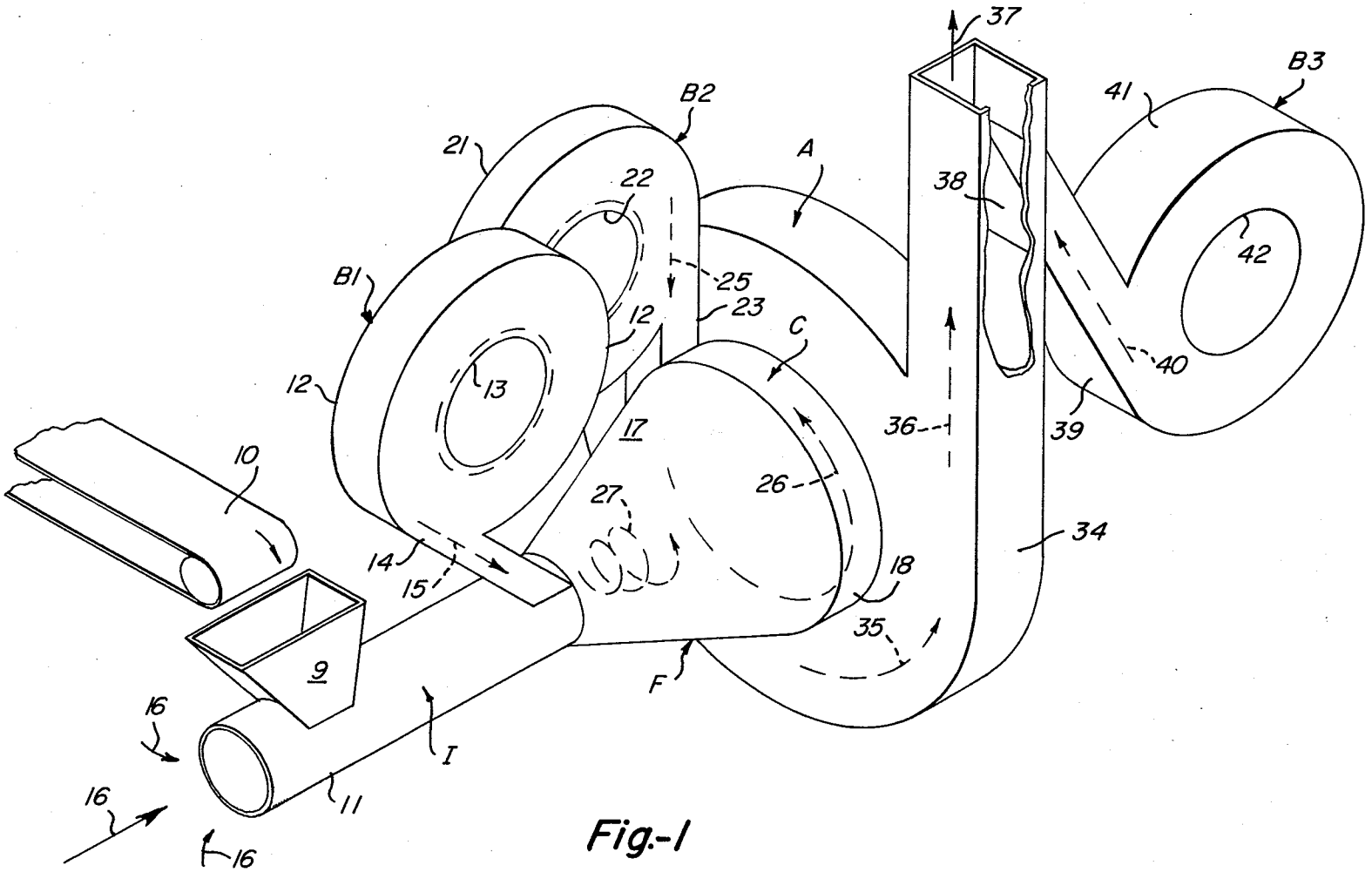
FIG. 1 is a perspective view of a preferred embodiment of the apparatus of this invention, particularly adapted to carry out the method thereof.

The apparatus for comminuting material, which is particularly adapted to carry out the method of this invention, may include an inlet chamber I of FIG. 1 connected to a frusto-conical chamber F connected to a cylindrical chamber C, in turn connected to an annular chamber A. Within annular chamber A is a restrictor R of FIG. 3, modifications of which are shown as restrictors R′ and R″ of FIGS. 5 and 7, respectively. A blower $B_1$ blows air longitudinally into inlet chamber I and frusto-conical chamber F, while a blower $B_2$ blows air tangentially into cylindrical chamber C for a purpose and with results described later. A blower $B_3$ assists the discharge of air and disintegrated material from annular chamber A, also in a manner described later.

Figure 2:
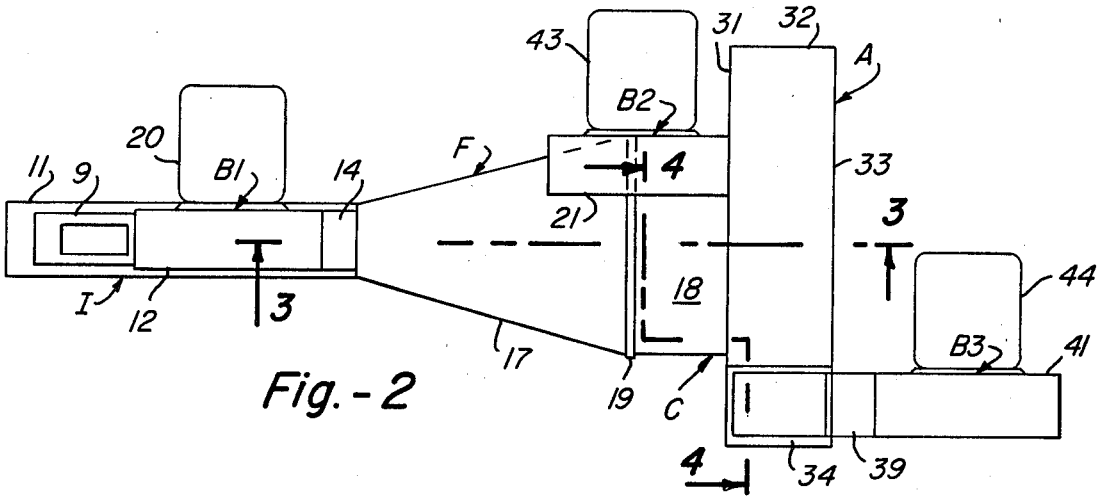
FIG. 2 is a top plan view of the apparatus of FIG. 1.
Figure 3:
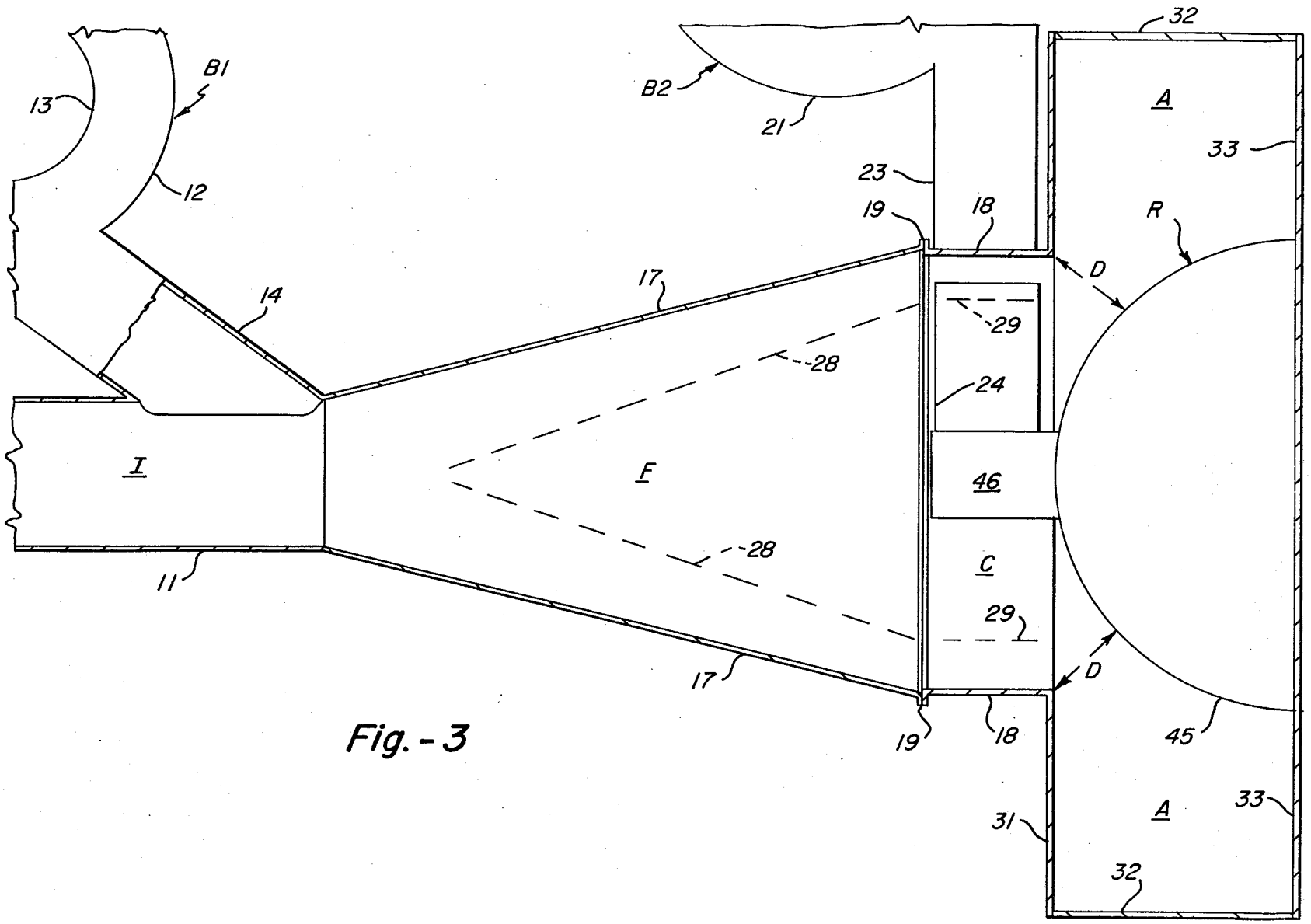
FIG. 3 is a longitudinal section, on an enlarged scale, taken along line 3—3 of FIG. 2.
Figure 4:
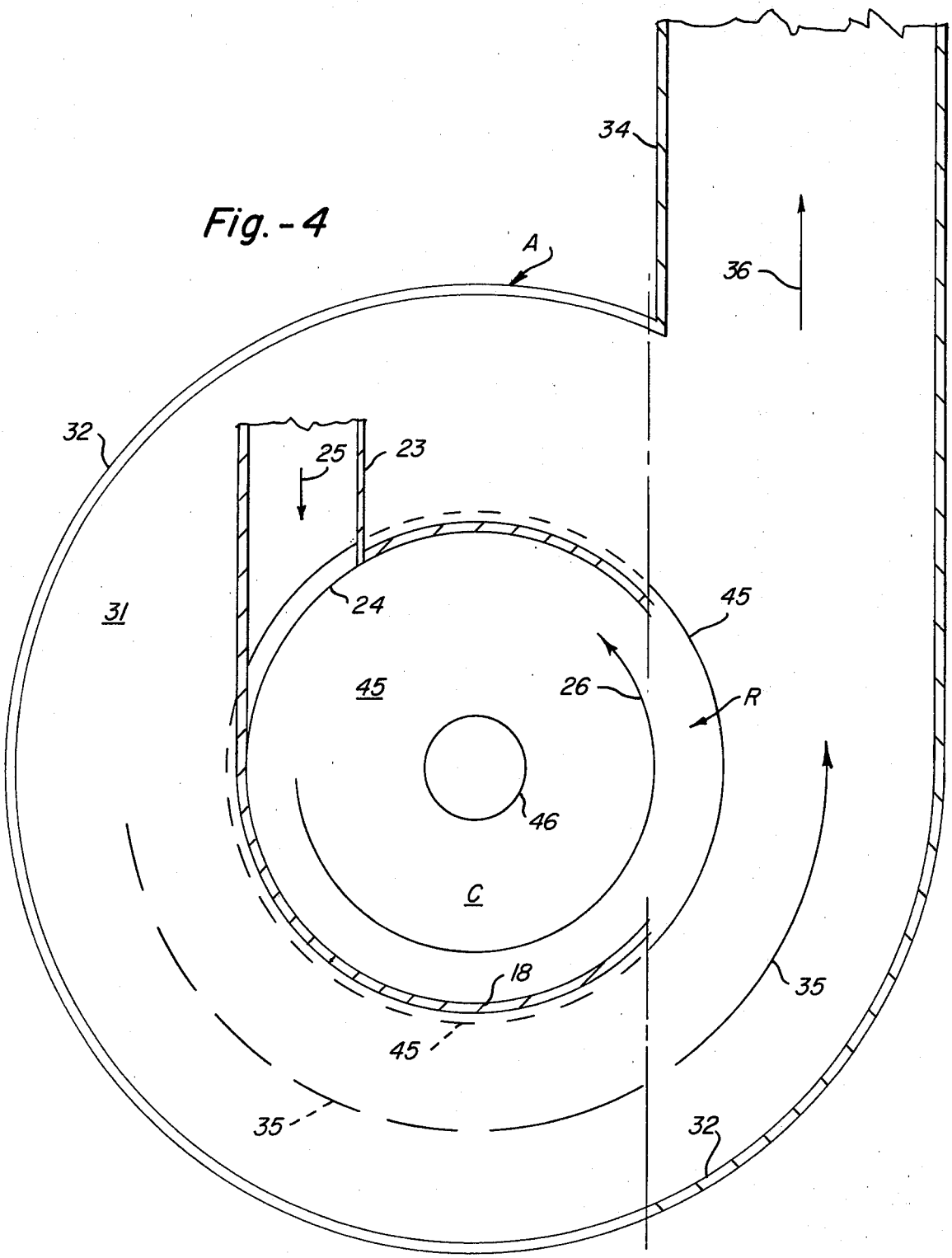
FIG. 4 is an offset transverse section, on an enlarged scale, taken along line 4—4 of FIG. 2.

Material to be comminuted is fed into a hopper 9 by a conveyor 10, as indicated by the arrows, and falls into a pipe 11 which forms the inlet chamber I. Hopper 9 may be provided with a control gate of a conventional nature (not shown) for controlling the rate of feed of the material. Blower $B_1$ has a casing 12 provided with an inlet 13 and a discharge duct 14, which extends angularly to the axis of pipe 9 and into which air is discharged in a longitudinal direction, as indicated by dotted arrow 15. Suction produced by air so moving in a longitudinal direction induces the flow of air indicated by arrows 16 at the inlet of pipe 11 to move the material discharged from hopper 9 along pipe 11 and into frusto-conical chamber F. Chamber F, as in FIG. 3, is formed by a frusto-conical casing 17, while chamber C is formed by a cylindrical casing 18, with casings 17 and 18 being conveniently removably attached together by flanges 19. Blower $B_1$ is driven by a motor 20 of FIG. 2. Blower $B_2$, having a casing 21 provided with an inlet 22, produces a flow of air through a discharge duct 23 which connects tangentially with cylindrical chamber C at opening 24 of FIG. 3, and through which air flows, as indicated by dotted arrow 25, to produce an intense circular flow of air around the periphery of chamber C, indicated by dotted arrow 26, with arrows 25 and 26 being solid arrows in the cross section of FIG. 4. This circular flow induces a spiral flow, indicated by arrow 27, in frusto-conical chamber F, which increases in diameter as the chamber increases in diameter and produces an area of higher pressure adjacent the inner periphery of casing 17 of chamber F of FIG. 3, as well as adjacent the inner periphery of casing 18 of chamber C. Within this area of higher pressure is a lower pressure area, quite marked in pressure difference and, in fact, a negative pressure, i.e. below atmospheric or a vacuum. The dotted lines 28 of FIG. 3 are representative of the edges of the conical line of demarcation between the vacuum area and the area at a pressure above atmospheric within chamber F, while dotted lines 29 are representative of the line of demarcation between the vacuum area and the area above atmospheric pressure within chamber C. As will be evident, the vacuum area tends to increase in diameter at a faster rate than the casing 17 of chamber F. It also increases in degree, i.e. a higher vacuum is obtained adjacent the larger end of chamber F. This is apparently due to expansion of air as it moves toward the larger end of chamber F. A manner of controlling the comminution is described later.

The outer wall of annular chamber A may be formed, as in FIG. 3, by an annular front plate 31, a peripheral cylindrical plate 32 and a rear circular plate 33, which may be attached together in a suitable manner, as by welding. Also, attached to plate 31 is a discharge duct 34 of FIG. 1, which extends tangentially from annular chamber A and receives exhaust air and comminuted material from the chamber, as indicated by dotted arrow 35, then leads it to a point of discharge, as indicated by dotted arrow 36 and solid arrow 37, past an opening 38 through which air from blower $B_3$ is directed longitudinally of duct 34 through blower duct 39, as indicated by dotted arrow 40. Blower duct 39 extends tangentially from a casing 41 having an inlet 42. Blower $B_2$ is driven by a motor 43 and blower $B_3$ is driven by a motor 44, each of FIG. 2. Duct 34 may lead to a conventional cyclone separator (not shown), in which the disintegrated material may be separated from the air stream. Further treatment of the disintegrated material will normally depend on the nature thereof and this aspect is discussed later.

The restrictor R of FIG. 3 is installed centrally within annular chamber A and may comprise a hollow hemisphere 45 which has a thick enough wall to withstand the impact and wear of the disintegrated material and may be attached to the rear plate 32 of chamber A, either in fixed relation, as by welding, or in removable relation, as by bolts or the like. The rear diameter of hemisphere 45 may be decreased from that shown, so that it may be removed through chamber C, after chamber F has been detached at flanges 19. An opening may be provided in plate 32, in a manner similar to annular plate 52 of FIG. 5, but with the restrictor R being removable through the opening, from the rear. A projection 46, such as cylindrical, may be removably or adjustably attached, or fixedly attached, as by welding, to the center front area of hemisphere 45, so as to extend into cylindrical chamber C, as to a position coinciding with or spaced an appropriate distance from the front end of chamber C.

In the operation of the apparatus of this invention, the distance D of FIG. 3, between the rear edge of chamber C and the nearest point on hemisphere 45, appears to be critical in that variations in this distance appear to affect the proportion of particles of a minimum size which will be produced by comminution. In considering the effect of the passage of material into the vacuum zone between lines 28 of FIG. 3, it will be noted that grinding, as in a ball or rod mill, produces particles whose surface passes through grain boundaries of the material, so that a mineral, for instance, to be recovered may comprise only a part of a particle produced by grinding, while the remainder of the particle is gangue. Thus, often the particle resulting still does not entirely contain the mineral material without gangue. In contrast thereto, the method and apparatus of this invention has resulted in a separation of the material along grain boundaries, so that the mineral is separated from the gangue and the separation is thus cleaner and thereby more effective. Variations in the distance D of FIG. 3 have produced a variation in the product of separation, with an optimum distance for the most effective separation. This distance tends to vary with the type of material being treated and it will, therefore, be necessary to predetermine the optimum distance for any new type of material being treated. The size of the grains of the material, when variations in grain size occur within the same material, do not appear to affect the separation as much as variations in the capacity, i.e. both pressure and volume produced, of blowers $B_1$, $B_2$ and $B_3$. Thus, an increase in velocity of the air discharged through duct 14 from blower $B_1$ has tended to produce a larger particle size, while a decrease in velocity of air discharges from blower $B_1$ has tended to produce a smaller particle size. However, a decrease in the velocity of the air discharged through duct 23 by blower $B_2$ has tended to produce a larger particle size, while an increase in the velocity of air discharged from blower $B_2$ has tended to produce a smaller particle size, again without substantial change in volume. Also, an increase in the velocity of the air discharged through duct 39 by blower $B_3$ has tended to produce an increase in the particle size, while a decrease in the velocity of air discharged by blower $B_3$ has tended to produce a decrease in the particle size. When the volume is changed without change in velocity, the effect of a greater volume of air tends to produce a result similar to an increase in velocity for blower $B_1$ but a result similar to a decrease in velocity for blower $B_2$. Also, a greater volume of air produced by blower $B_3$ has tended to produce a result similar to an increase in velocity. The increase in particle size by an increase in the velocity for blower $B_3$ is apparently due to an increase in the speed of the air discharged by blower $B_3$ having a greater aspirating effect upon the air and material being exhausted from annular chamber A, with the result that the air tends to be removed faster from chamber A and thereby producing a somewhat faster flow of material from the cylindrical chamber C. A change in the speed of the air discharged by two or more of the blowers may also tend to have opposing effects. Thus, it may be necessary, when a new material is to be treated, to ascertain the air velocity which produces the optimum effect.

The distance D may be adjusted to obtain the desired particle size, in a manner similar to that described below for gold ore and tar sands.

As will be evident, the method of this invention also involves preventing the flow of air and material through an axially circular, central portion of the cylindrical chamber, as well as preventing the flow of air and material through a portion of the generally annular chamber beginning generally at the central circular portion of the cylindrical chamber and expanding radially in an axial direction in the generally annular chamber. As described hereinbefore, such portion of the generally annular chamber through which flow is prevented may be hemispherical in form, but as described hereinafter, such portion may be frustro-conical in form and may be adjusted axially of the generally annular chamber. As also described hereinafter, such portion of the cylindrical chamber through which flow is prevented also may be adjusted axially of the cylindrical chamber, while the inner end thereof may be rounded.

Figure 5:
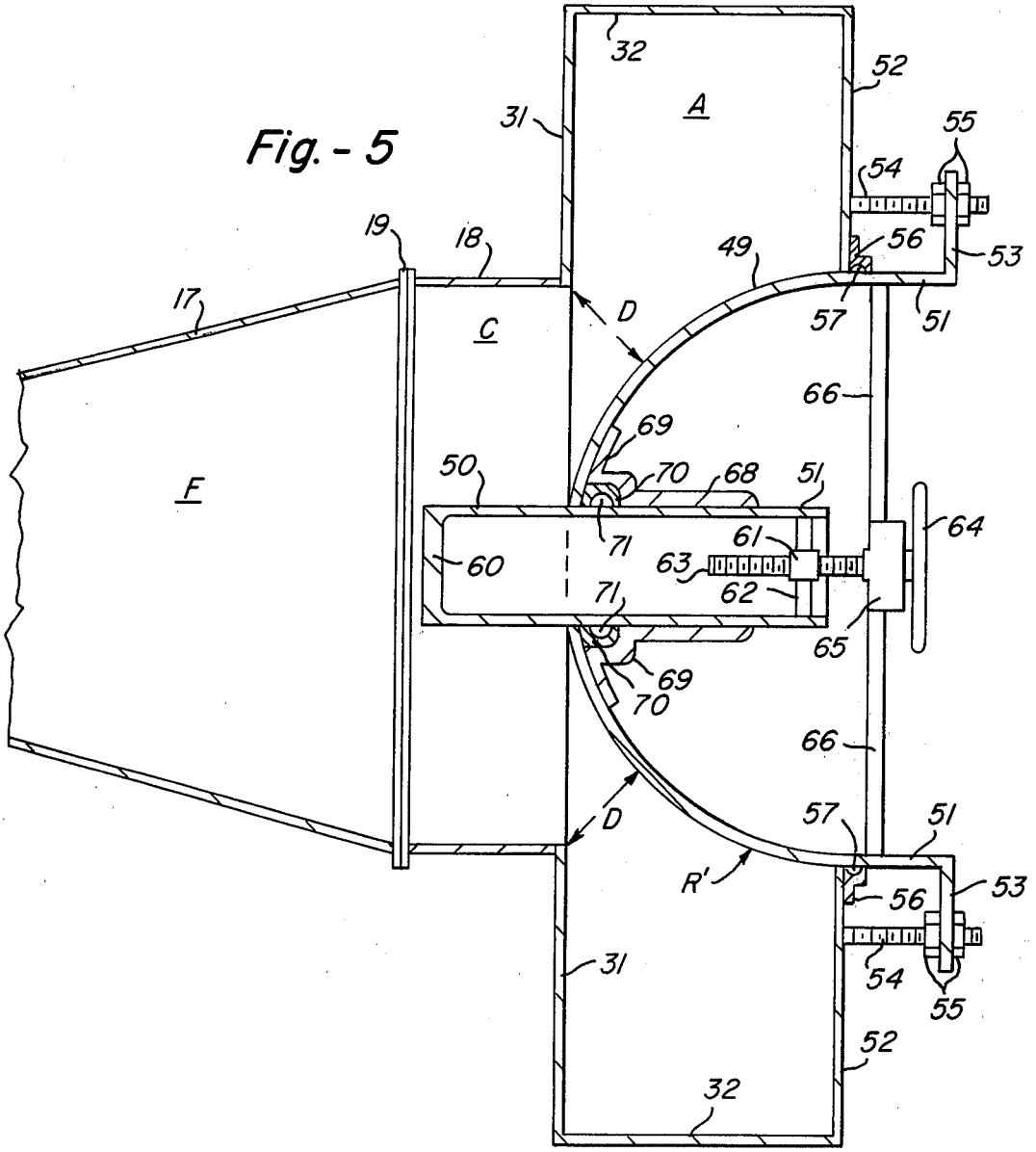
FIG. 5 is a fragmentary longitudinal section similar to a portion of FIG. 3 but showing an alternative, adjustable restrictor.

Modifications of the foregoing method and apparatus may be utilized, such as the modification shown in FIG. 5 in which a restriction R′ includes an alternative hemisphere 49 and an alternative projection 50. Alternative hemisphere 49 is provided with a cylindrical rear portion 51 which is movable within an opening in an annular rear plate 52 for chamber A and is provided with a laterally extending flange 53 at the rear. Flange 53 may engage a series of studs 54 which may be welded to the rear plate 52 and receive nuts 55 for adjusting the alternative hemisphere 49 inwardly and outwardly within the annular chamber A, thereby increasing or decreasing the distance D. A seal ring 56 may be attached to the rear plate 52 around the cylindrical rear end 51 of hemisphere 49 and may be provided with a recess 57 in which a packing may be installed to prevent leakage of air from around the hemisphere. The seal ring 56 and packing recess 57 are placed outside the chamber A, in order to minimize the contact of abrasive particles with the packing. The alternative projection 50 is also adjusted inwardly and outwardly with respect to the hemisphere 49, primarily to maintain the desired position of the inner end 60 of the projection with respect to the front edge of the cylindrical chamber C. The inner end 60 of the projection may be thickened as shown, to withstand any possible bombardment of particles. For adjustment of the projection 50, its open rear end may be provided with an interiorly threaded ring 61, supported centrally by a series of arms 62, each of which may be welded at one end to ring 61 and at the opposite end to the inside of the projection. The threads of the ring 61 are engaged by a screw 63 which extends outwardly to a handwheel 64 which is supported by a bearing 65, in turn supported within hemisphere 49 by arms 66 which are attached to bearing 65 and to the inside of rear portion 51 of the hemisphere. A ratchet, not shown but similar to conventional ratchets, may be associated with the handwheel 64 in order to secure screw 63 in any adjusted position of the projection. Inside hemisphere 49, projection 50 engages a guide sleeve 68 which is attached to the inside of the hemisphere as by an offset flange 69 which may be welded to the inside of the hemisphere or removably attached, as by studs and nuts. An offset in flange 69, as shown, provides space for receiving a seal ring 70 which has a space 71 for holding packing against the outer surface of the projection 50. Again, the packing is positioned exteriorly of the chamber A, to avoid damage to the packing by fast moving particles.

Figure 6:
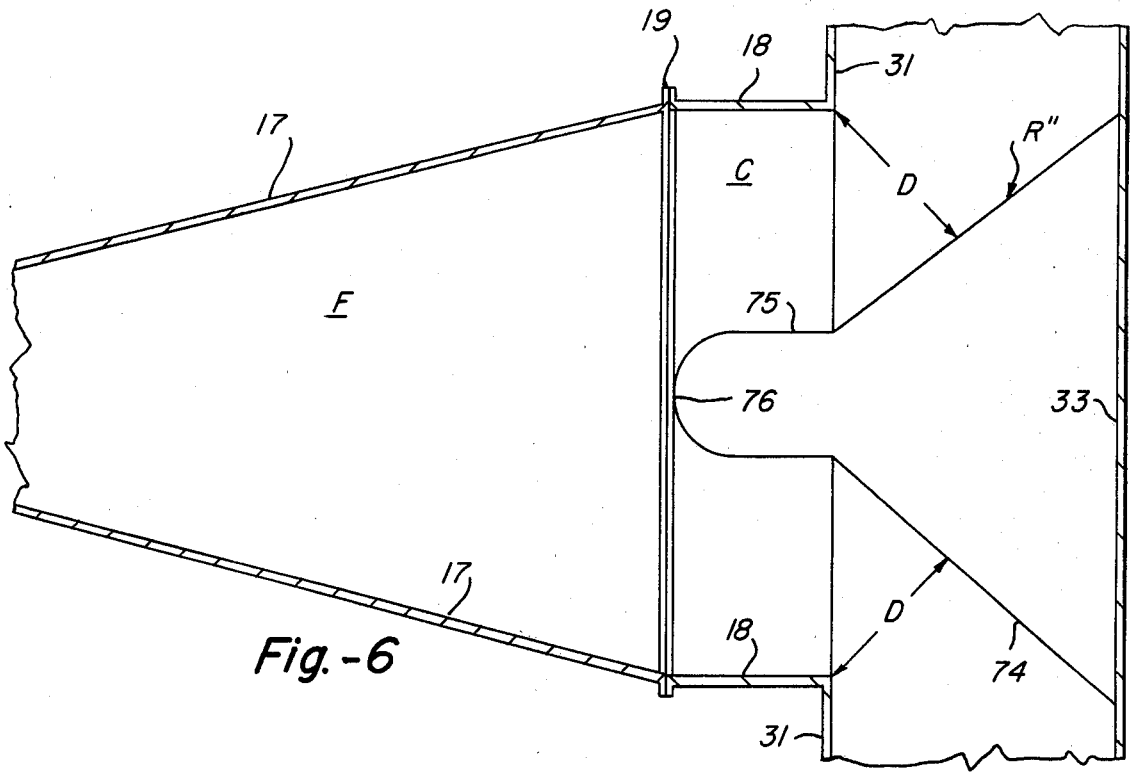
FIG 6 is a fragmentary longitudinal section, corresponding to a portion of FIG. 3 and showing an alternative interior construction.

In the further alternative construction shown in FIG. 6, a further alternative restrictor R" includes a hollow cone 74 which may be attached, as by welding, or removably attached, to rear plate 33 for annular space A. An alternative projection 75, which is shown as fixed but may be adjustable, extends into the center of chamber C from cone 74. Projection 75 is shown as having a convex inner end 76, such as hemispherical, but may be flat, similar to projection 46 of FIG. 3. Again, the distance D between the cone and the rear edge of chamber C may be proportioned to produce a maximum number of particles of a desired size during comminution.

Figure 7:
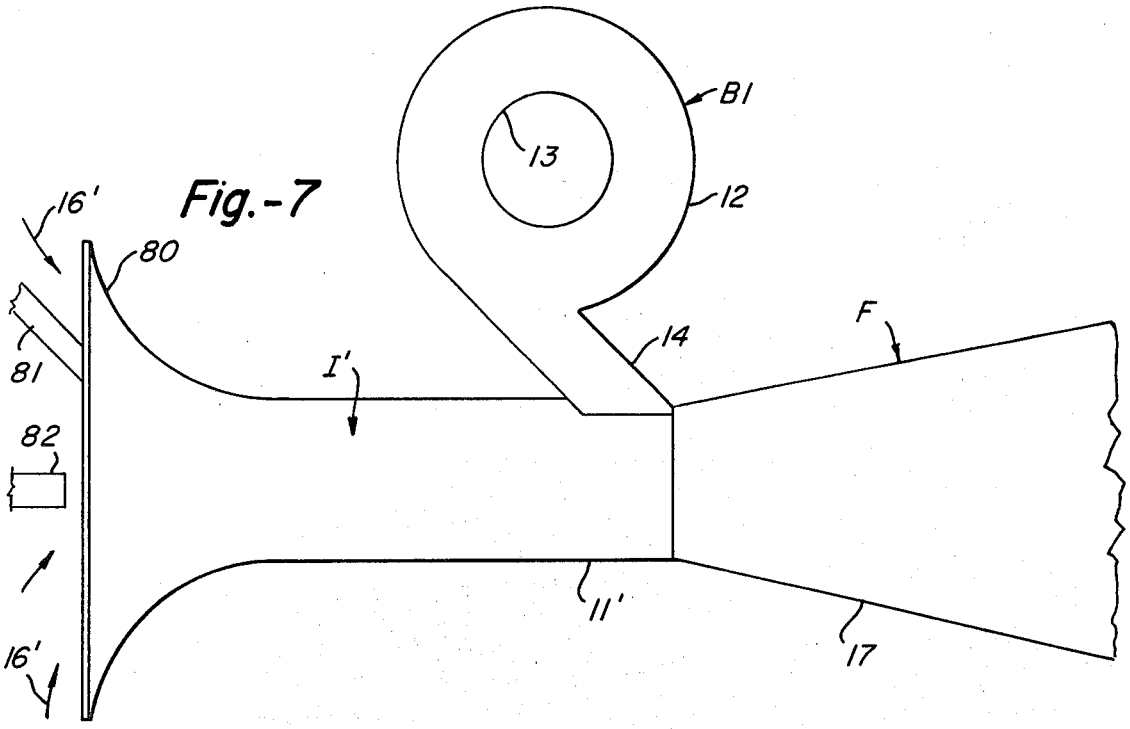
FIG. 7 is a fragmentary side elevation, corresponding to a portion of FIG. 1 and showing an alternative inlet construction.

In the alternative construction of FIG. 7, a chamber I' formed by a pipe 11' is provided with a flared inlet 80 and connects with pipe 17 for chamber F. Blower $B_1$, having a casing 12 and an inlet 12 as before, may be placed in a similar manner above pipe 11', with duct 14 extending angularly to pipe 11' for discharging air into chambers I' and F in a longitudinal direction. As before, air is induced into the inlet end of chamber I', as indicated by arrows 16'. Material may be fed into the inlet of pipe 11' down a chute 81, while a nozzle 82 may be positioned centrally of the inlet, or in other suitable position, for spraying a desired fluid into the chamber. Such a fluid may be a wetting agent, such as an NaOH solution for treating tar sands, so that the bitumen will not only be separated from the sand grains, but will also flow on through the apparatus without collecting on the inside surfaces of chamber C, chamber A or duct 34, or the exterior surfaces of restrictor R, R' or R".

The following examples will illustrate the application of the principles of this invention, as demonstrated by test devices of apparatus for carrying out the method of this invention, it being noted that larger sizes, as in corresponding proportions, may be utilized for commercial purposes.

EXAMPLE 1

An apparatus constructed in accordance with FIG. 6, but with the projector as shown in FIG. 3, included an inlet passage 6 in. in diameter but only 4 in. long, to which material crushed to less than 2 in. in size was fed to the inlet end. The frusto-conical chamber F had an inlet diameter of 6 in. and an outlet diameter of 15 in., with a length of 24 in. The cylindrical chamber C also had a diameter of 15 in. and an axial thickness of 4 in., while the annular chamber A had a diameter of 28 in. and an axial thickness of 7.5 in. The cone of restrictor R had a length of 7.5 in., a rear diameter of 7.5 in. and a front diameter of 3 in. The projection of restrictor R had a diameter of 3 in. and a length of 4 in. Each of blower $B_1$, $B_2$ and $B_3$ were driven by a 20 hp motor.

A quartz ore containing gold was treated and the particles produced varied from −150 mesh to −500 mesh. Particles of −200 mesh were examined microscopically and were found to include actual quartz crystals in that size range.

A manganese ore, a pyrite sulfide gold ore and a telluride ore with gold treated with the same reduction in size but different amounts of −200 mesh and −500 mesh, apparently depending upon the dimensions between boundary lines.

Oil shale from Colorado was also treated, with the size of the particles produced being −150 mesh with some smaller, including −500 mesh.

Measurement of air velocity at the center of the inlet of chamber F were taken, with all fans operating at rated horsepower but without any material passing through the chamber. A measurement of 18,000 feet per minute was obtained. The flow of air was calculated as being 4900 cubic feet per minute through chamber F. Static pressure tests were also made at the top of chamber C, without material passing through, and similarly at the junction of chamber F with chamber C and at the centerline of the top of annular chamber A. The measurements obtained were 2 in. of water above atmospheric at the top of chamber A and between 4 and 5 in. above atmospheric at the top of chamber C and the junction between chambers C and F.

EXAMPLE 2

The apparatus of Example 1 was utilized in treating tar sands from Utah which are reported to comprise approximately 93% of U.S. deposits. These sands differ from Canadian tar sands, the bitumen of which is capable of recovery by a hot water process, since the bitumen in the Canadian tar sands is separated from the sand grains by connate water, reported to be 3% to 5% by weight. However, the Utah tar sands are reported to be so dry that their moisture content cannot be detected by standard analytical techniques and that the bitumen is directly in contact with and bonded to the surface of the sand particles, thus rendering recovery by a hot water process extremely difficult. Also, the viscosity of the bitumen of the Utah deposits is reported to be about two orders of magnitude greater than the viscosity of the Canadian bitumen.

The bitumen was liberated from the Utah tar sands, apparently as readily as the quartz ore was separated, although screen tests were not performed. The liberated bitumen was separated from the sands centrifugally, although some bitumen still adhered to the sands and some bitumen tended to stick to the cone of the restrictor, although to a lesser extent than a hemispherical restrictor. However, the introduction of a wetting agent, such as an NaOH solution, as shown in FIG. 6, appeared to alleviate this problem. Also, heating of the separated sands, as by microwaves, to remove the last vestige of bitumen, appeared desirable.

EXAMPLE 3

The apparatus of FIG. 1 was modified to be utilized to treat coal which was wet to preclude the possibility of explosions. The length of inlet passage I was increased to 3 ft. and a hopper added, while the coal was fed into the hopper from hoist supported barrels. The coal particles produced all passed through a wet screen of 150 mesh, it being difficult to measure smaller particles because of wetness.

EXAMPLE 4

The apparatus of Example 1 was modified to reduce the diameter of the inlet passage I and the inlet of chamber F to 5 in., with the outlet of chamber F remaining at 15 in. The length of chamber F was increased to accommodate the smaller inlet diameter, but other dimensions remained the same. The quartz gold ore of Example 1 was treated, because of its hardness, with approximately the same results.

EXAMPLE 5

The apparatus of Example 1 was modified to reduce the diameter of the inlet passage I and the inlet diameter of chamber F to 4 in., with the outlet diameter of chamber F remaining at 15 in. An appropriate increase in length of chamber F was again made, but other dimensions remaining the same. Again, the quartz gold ore of Example 1 was treated, and it was found necessary to further reduce the speed of the motor of blower $B_1$ to produce as fine particles, but with a reduction in the capacity for material.

EXAMPLE 6

The apparatus of Example 1 was modified to reduce the diameter of inlet passage I and the inlet diameter of chamber F to 3 in., again with an outlet diameter of 15 in. and a corresponding increase in the length of chamber F to accommodate the smaller inlet diameter. The quartz gold ore of Example 1 was again treated and it was found necessary to further reduce the speed of the motor driving blower $B_1$ in order to secure as fine a size of particles, with a further reduction in the capacity for material.

EXAMPLE 7

The apparatus of Example 1 was modified to reduce the diameter of inlet passage I and the inlet diameter of chamber F to 2 in. with a corresponding increase in length of the chambers. The quartz gold ore of Example 1 was again treated, but a very small portion of the ore was reduced to a finer size, while the remainder of the ore appeared to pass through the apparatus without comminution. It was concluded that, in the arrangement of Example 1, a ratio of more than 5 to 1 between the outlet and inlet diameters of chamber F would be undesirable.

EXAMPLE 8

The apparatus of Example 1 was modified to decrease the length of chamber F from 24 in. to 18 in. with other dimensions remaining the same. Similar results were obtained in treating the quartz gold ore.

EXAMPLE 9

Apparatus also constructed in accordance with this invention was built, similar to the apparatus of Example 1 with the inlet passage I and the inlet of chamber F having a diameter of 6 in. but the outlet of chamber F having a diameter of 9 in. and the length of chamber F was 15 in. The diameter of chamber C was 9 in. and its thickness was 2.4 in., while the diameter of chamber A was 16.7 in. and its thickness 5 in. The rear diameter and length of the cone of restrictor R was 5 in., while its front diameter was 3 in. and the projector was 3 in. in diameter and 2.4 in. in length.

This apparatus was operated mainly with a quartz gold ore feed, and it was found that the size of the particles produced was generally greater than those produced in Example 1. It was also found that a variation of the speed of the motors driving blowers $B_1$ and $B_2$ would change the size of the particles produced, with larger particles being produced with a lower speed of the motors driving blowers $B_1$ and $B_2$. In fact, the speed of the motors driving blowers $B_1$ and $B_2$ could be sufficiently reduced until all of the particles were +100 mesh. The results also varied similarly for tests of sulfide ore and an agglomerate or cemented sedimentary type of ore.

EXAMPLE 10

The apparatus of Example 9 was modified to reduce the diameter of inlet passage I and the inlet diameter of chamber F to 5 in., with a lengthening of chamber F to accommodate the decrease in inlet diameter but with all other dimensions remaining the same. It was found that the speed of the motors driving blowers $B_1$ and $B_2$ needed to be increased in order to produce fine sized particles of −200 mesh. Materials tested included the quartz gold ore, the Colorado oil shale, the Utah tar sand and coal.

EXAMPLE 11

The apparatus of Example 9 was modified to reduce the diameter of the inlet passage I and the inlet diameter of chamber F to 4 in., 3 in., and 2 in., respectively, with a corresponding increase in the length of chamber F but with all other dimensions remaining the same. Tests of the same materials as used in Example 10 indicated that a reduction in the size of the material fed to the inlet passage, together with a reduction in the speed of the motors driving blowers $B_1$ and $B_2$, as well as a reduction in the rate of feed were needed to secure particles of −200 mesh, as in Example 10.

EXAMPLE 12

Apparatus constructed in accordance with FIG. 3 was built, having an inlet passage I of 6 in. in diameter, a chamber F having an inlet diameter of 6 in., an outlet diameter of 15 in. and a length of 18 in. The chamber C had a diameter of 15 in. and a thickness of 3.5 in., while chamber A had a diameter of 28 in. and a thickness of 7.5 in. The hemisphere of the restrictor R had a radius of 7.5 in., while the projection had a diameter of 3 in. and a length of 4 in. Using the quartz gold ore of Example 1 resulted in a greater proportion of finer sizes, even when a faster feed rate was utilized. Similar results were secured with a galena ore, containing lead and silver. The Utah tar sands were similarly reduced to smaller sizes than in Example 1, although as previously indicated, there appeared to be less of a problem of bitumen adhering to a conical restrictor than a hemispherical restrictor. Coal was reduced in size to −150 mesh.

In addition to the possibility of shifting blower $B_1$ to discharge directly into the open inlet end of inlet I, an additional blower may discharge tangentially into annular chamber A, so as to increase the velocity of air movement through chamber A as well as increase the velocity of movement of air through chambers C and F.

Although a preferred embodiment of this invention, as well as certain variations thereof, have been illustrated and described, it will be understood that other embodiments may exist, as well as variations thereof, without departing from the spirit and scope of this invention.

What is claimed is:

1. A method of comminuting material comprising:

producing a flow of air longitudinally through a circular passage in the direction of a connected chamber which expands in size toward a connected cylindrical chamber;

producing a flow of air tangentially of said cylindrical chamber in order to produce a spiral flow in said expanding chamber, a lower pressure centrally of said expanding chamber and a higher pressure toward the periphery of said expanding chamber;

feeding material to be comminuted into said circular passage;

producing the discharge of air and material essentially tangentially from a generally annular chamber having an outer diameter exceeding the outer diameter of said cylindrical chamber, said annular chamber being connected to said cylindrical chamber;

preventing the flow of air and material through an axial, circular central portion of said cylindrical chamber; and preventing the flow of air and material in a portion of said generally annular chamber beginning generally at said central circular portion of said cylindrical chamber and expanding radially in an axial direction in said generally annular chamber.

2. A method as defined in claim 1, including:

feeding material to be reduced in size into said circular passage adjacent its inlet end.

3. A method as defined in claim 1, including:

preventing flow of air and material through an axial, circular central portion of said cylindrical chamber whose inner end is rounded.

4. A method as defined in claim 3, including:

preventing flow of air and material through a portion of said generally annular chamber which expands radially in an axial direction in a hemispherical form.

5. A method as defined in claim 3, including:

preventing flow of air and material through a portion of said generally annular chamber which expands radially in an axial direction in a frustro-conical relationship.

6. A method as defined in claim 1, including:

feeding material to be reduced in size into the open inlet end of said circular passage.

7. A method as defined in claim 1 including:

providing a frustro-conical shape of said expanding chamber.

8. A method as defined in claim 1, including:

providing an axial dimension of said expanding chamber greater than the axial dimension of said cylindrical chamber.

9. A method as defined in claim 1, including:

adjusting the axial position of said portion of said annular chamber through which flow of air and material is prevented.

10. A method as defined in claim 9, including:

adjusting the axial position of said portion of said cylindrical chamber through which flow of air and material is prevented.

11. Apparatus for comminuting material comprising:

a circular passage connected to a chamber which expands in size toward a connected cylindrical chamber;

means for producing a flow of air generally longitudinally of said circular passage into said expanding chamber;

means for producing a flow of air tangentially of said cylindrical chamber to produce a spiral flow in said expanding chamber;

means for feeding material to be reduced in size into said circular passage;

a generally annular chamber having an outer diameter exceeding the outer diameter of said cylindrical chamber, said annular chamber being connected to said cylindrical chamber and surrounding a central restrictor spaced inwardly from the juncture of said cylindrical chamber and annular chamber but increasing in size rearwardly, said restrictor having a projection extending into said cylindrical chamber in a central position thereof; and means for producing a discharge of air and material essentially tangentially from said annular chamber.

12. Apparatus as defined in claim 11, including:

a discharge duct extending tangentially from said annular chamber, so as to induce in increase in the discharge of air and material from said annular chamber; and means for producing a flow of air generally longitudinally of said duct.

13. Apparatus as defined in claim 12, including:

means for feeding material to be reduced in size into said circular passage.

14. Apparatus as defined in claim 11, wherein:

said circular passage is elongated.

15. Apparatus as defined in claim 14, including:

means for feeding material to be reduced in size into said elongated passage rearwardly of the open inlet end of said passage.

16. Apparatus as defined in claim 14, including:

means for feeding material to be reduced in size into the open inlet end of said circular passage.

17. Apparatus as defined in claim 14, wherein:

the open inlet end of said elongated passage flares outwardly.

18. Apparatus as defined in claim 11, wherein:

said expanding chamber is frusto-conical in shape.

19. Apparatus as defined in claim 11, wherein:

said expanding chamber has an axial dimension greater than said cylindrical chamber.

20. Apparatus as defined in claim 11, including:

means for adjusting the axial position of said restrictor in said annular chamber in order to adjust the distance between the circle of the rear end of said cylindrical chamber and the surface of said restrictor.

21. Apparatus as defined in claim 20, including:

means for adjusting the axial position of said projection in said cylindrical chamber.

22. Apparatus as defined in claim 11, wherein:

said restrictor in said annular chamber has a generally hemispherical surface.

23. Apparatus as defined in claim 11, wherein:

said restrictor in said annular passage has a generally conical surface.

24. Apparatus as defined in claim 11, wherein:

said projection of said restrictor is cylindrical.

25. Apparatus as defined in claim 11, wherein:

said projection of said restrictor is generally cylindrical rearwardly from a convex front end.

26. Apparatus as defined in claim 25, wherein:

said front end of said projection is generally hemispherical.

27. Apparatus as defined in claim 11, including:

an air blower having a discharge duct extending at an acute angle to an opening in the periphery of said alongated passage.

28. Apparatus as defined in claim 11, including:

an air blower having a discharge duct extending tangentially to an opening in the periphery of said cylindrical chamber.

29. Apparatus as defined in claim 11, including:

a first discharge duct extending tangentially from the periphery of said annular chamber; and a blower having a second discharge duct extending at an acute angle to an opening in said first discharge duct.

* * * * *